United States Patent [19]

Olson

[11] Patent Number: 4,491,821

[45] Date of Patent: Jan. 1, 1985

[54] DIFFERENTIAL TEMPERATURE CONTROL

[75] Inventor: Elwyn H. Olson, St. Paul, Minn.

[73] Assignee: Honeywell Inc., Minneapolis, Minn.

[21] Appl. No.: 497,344

[22] Filed: May 23, 1983

[51] Int. Cl.[3] ..... H01H 37/36

[52] U.S. Cl. ..... 337/307; 200/83 D; 337/321

[58] Field of Search ..... 337/307, 308, 306, 320, 337/321, 323, 326, 332, 114, 117, 119; 200/83 A, 83 D, 83 SA

[56] References Cited

U.S. PATENT DOCUMENTS

| | | | |
|---|---|---|---|
| 343,691 | 6/1886 | Baulieu | 337/307 |
| 2,067,959 | 1/1937 | Wasson . | |
| 2,226,297 | 12/1940 | Spangenberg . | |
| 2,404,596 | 7/1946 | Roche, Jr. . | |
| 2,536,831 | 1/1951 | Allan . | |
| 3,139,501 | 6/1964 | Cook | 337/321 |
| 3,358,605 | 12/1967 | Ayers . | |

*Primary Examiner*—Harold Broome

*Attorney, Agent, or Firm*—Mitchell J. Halista; Trevor B. Joike

[57] ABSTRACT

A differential temperature control uses a first temperature expansion element for driving a first pivoted lever supporting a selectively operable switch and a second temperature expansion element for driving a second pivoted lever for operating the switch. The position of the switch operating lever with respect to the switch is achieved by either the first or second temperature expansion element which move the first lever and the second lever, respectively, in direct proportion to a change in the corresponding sensed temperatures. In the case of a movement produced by the temperature expansion element controlling the position of the switch, a similar temperature change sensed by the second temperature element would be needed to "chase" the switch to restore a switch actuation relationship to produce a differential temperature control. A selective adjustment of the spacing of the second lever with respect to the switch is used to change the differential temperature that will produce a switch actuation.

8 Claims, 1 Drawing Figure

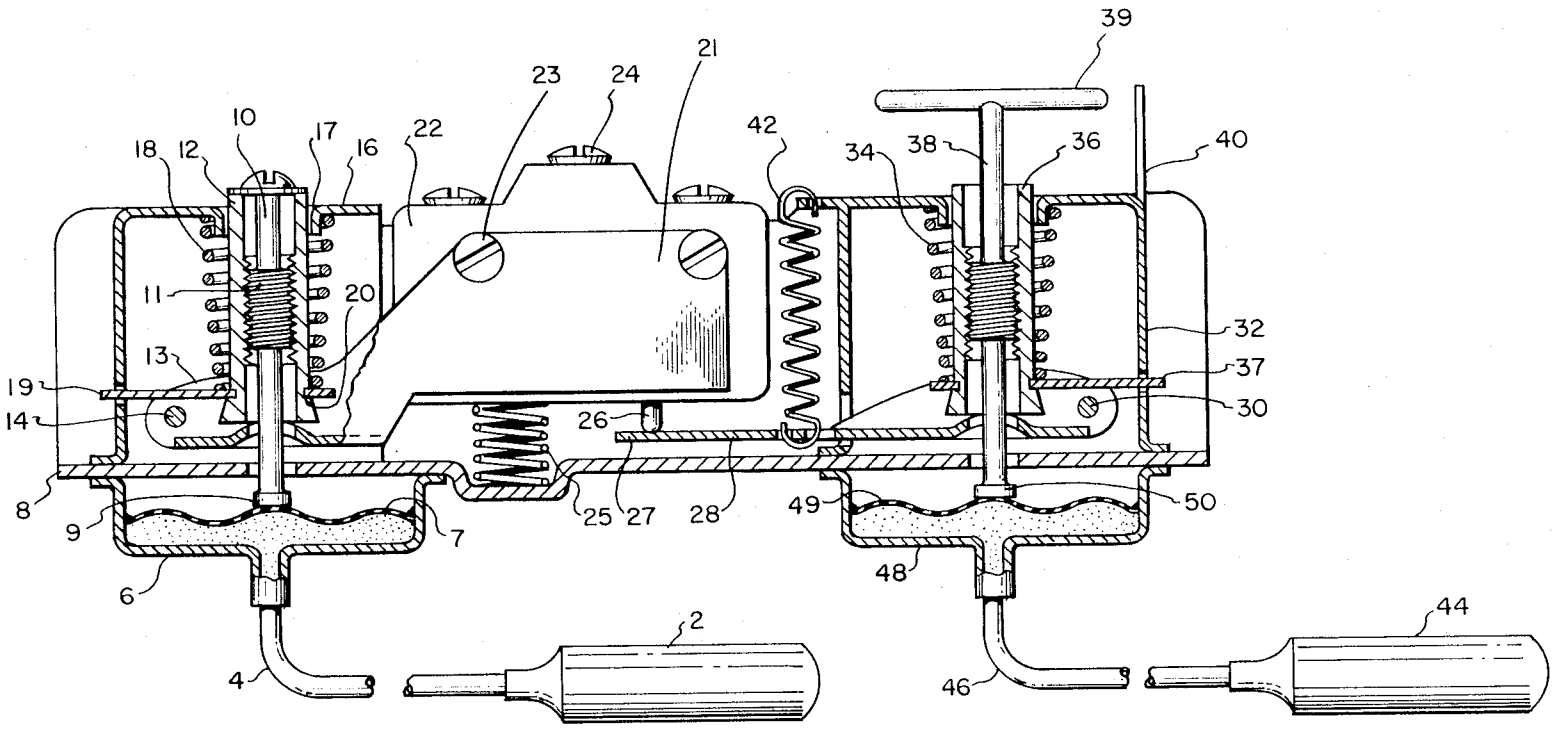
44
40
32
37
30
50
39
36
46
38
34
48
49
42
28
21
2
24
27
26
25
23
7
22
16
20
17
10
4
12
18
11
13
6
9
19
14
8

DIFFERENTIAL TEMPERATURE CONTROL

BACKGROUND OF THE INVENTION

Field of the Invention

The present invention relates to differential temperature controls. More specifically, the present invention is directed to a differential temperature control for producing a switch actuation dependent upon a differential temperature.

SUMMARY OF THE INVENTION

An object of the present invention is to provide an improved differential temperature control.

In accomplishing this and other objects, there has been provided, in accordance with the present invention, a differential temperature control having a first pivoted lever supporting a selectively actuable switch means having a switch actuator, a second pivoted lever having a switch actuating free end facing the switch actuator, a first temperature sensitive means for rotating the first lever about its pivot, and a second temperature sensitive means for rotating of the second lever about its pivot, the first lever including a first spring means arranged to maintain a contact between the first lever and the first temperature responsive means by means of a length expandable means arranged to selectively vary the rotational position of the first lever on its pivot independently of the first temperature responsive means.

BRIEF DESCRIPTION OF THE DRAWING

A better understanding of the present invention may be had when the following detailed description is read in connection with the accompanying single FIGURE drawing in which there is shown a pictorial illustration of a differential temperature control embodying an example of the present invention.

DESCRIPTION OF THE PREFERRED EMBODIMENT

Detailed Description

Referring to single FIGURE drawing in more detail, there is shown an example of a differential temperature control embodying the present invention and having a first temperature expansion element 2 connected by a capillary tube 4 to a temperature responsive actuator 6. The bulb element 2, the capillary tube 4 and the actuator 6 may be filled with a temperature sensitive fluid whereby an expansion of the fluid in the bulb 2 is communicated via the capillary 4 to produce a motion of the actuator 6, in a manner well-known in the art. For example, the actuator 6 may include an internal diaphragm 7 which divides the interior of the housing of the actuator 6 to separate the temperature sensitive fluid from the environment surrounding the actuator 6. The actuator 6 is mounted in a fixed location on a support base 8. A first end 9 of an actuator rod 10 is arranged to contact the diaphragm 7 in the actuator 6 on the side of the diaphragm 7 opposite to that contacted by the temperature sensitive fluid and to be selectively positioned by an expansion of the temperature sensitive fluid in the bulb 2 and the tube 4. A central portion 11 of the rod 10 is threaded and cooperates with internal threads of a nut 12. One end of the nut 12 is arranged to bear against a first lever arm 13 which is pivoted at one end on pivot 14.

A first support frame 16 is rigidly mounted on the base 8 and is positioned adjacent to the pivoted end of the first lever arm 13 to laterally restrain the other or free end of the nut 12 while allowing a rotation thereof. Specifically, the free end of the nut 12 is located in a hole 17 in the frame 16. A first coaxial compression spring 18 is located between an internal surface of the frame 16 and a first plate 19 attached to the frame 16 and having an opening therein encircling the nut 12 within a peripheral groove 20 located adjacent to the end of the nut 12 bearing on the lever arm 13. The spring 18 is used to maintain pressure on the first end of the nut 12 to ensure a contact thereof with the pivoted end of the first level arm 13 and a contact between the groove 20 and the plate 19. The plate 19 is attached at one end to the frame 16, and the spring augmented friction between the groove 20 and the plate 19 restrains the nut 20 from turning. The spring 18 also maintains the first end of the rod 10 in contact with the diaphragm 7 by applying pressure thereon through the threaded connection between the rod 10 and the nut 12.

A free end 21 of the lever 13 is arranged to support a selectively actuable electrical switch 22 which may be mounted thereon by mounting screws 23. The switch 20 is provided with electrical connection screws 24 for securing the ends of electrical conductors (not shown) thereto. A second coaxial compression spring 25 is located between the housing of the switch element 22 and the support base 8 to stabilize the motion of the switch 22 by maintaining a contact between the lever 13 and the end of the nut 12. A switch actuator pin 26 protruding from the switch 22 is positioned with its free end facing the free end 27 of a second lever 28. The second lever 28 is pivoted on a pivot 30 at the other end thereof. The pivoted end of the lever 28 is positioned adjacent to a second support frame 32 containing a third coaxial spring 34 encircling a second mechanically adjustable and length expandable nut and rod combination similar to the first expandable nut 12 and rod 10. Thus, the third spring 34 extends between a free end of a second nut 36 and the second frame 32. A second plate 37 attached to the second frame 32 is arranged to restrain the rotation of the second nut 36 in response to the spring pressure from the third spring 34 in a manner similar to that effected by the first plate 19 on the first nut 12. The free end of the second nut 36 rests on the pivoted end of the second lever 28 to transfer the pressure of the spring 34 thereto.

A second actuator rod 38 passing through the second nut 36 has a first end connected to a dial 39 for indicating the effect of a manual adjustment of the second rod 38 and nut 36 structure. The dial 39 may have markings on its face (not shown) to cooperate with a fixed pointer 40 attached to the second frame 32 for indicating the differential temperature setting of the differential temperature control. An expansion spring 42 is connected between the second pivoted lever 28 and the frame 32 to oppose the spring 34 to provide a stabilizing function for the lever 28 in a manner similar to that provided by the spring 25 on the switch 21.

A second temperature expansion bulb 44 is connected via a second capillary 46 to a second mechanical actuator 48. The second bulb 44 and capillary 46 may also be filled with a temperature sensitive fluid in a manner similar to the first bulb 2 and the first capillary 4. Thus, the second actuator 48 would include a second diaphragm 49 in contact with a second end of the second rod 38 to isolate the temperature sensitive fluid and to transmit a motion induced by a temperature expansion of the temperature sensitive fluid in the second bulb 44 to the lever 28.

In operation, a temperature induced expansion of the fluid in the second bulb 44 is effective to move the free end 27 of the second pivoted lever 28 in a direction to actuate the switch 22. Conversely, a temperature expansion of the fluid in the first bulb 2 is effective to move the switch 22 by means of the lever 13 away from the free end 27 of the actuating lever 28. Thus, in order to restore an actuation of the switch 22, the temperature bulb 44 wold have to experience a relatively greater temperature rise to move the second pivoted lever 28 toward the actuating pin 26 of the switch means 22 to offset the aforesaid motion of the first lever 13, i.e., the free end 27 of the second lever 28 would "chase" the actuating pin 26 of the switch 22. In order to change the differential temperature needed to produce an actuation of the switch 22, the second expandable rod 38 and nut 36 structure can be adjusted by a rotation of the dial 39 and the attached rod 38. This rotation is effective to vary the position of the nut 36 on the rod 38 to vary the rotational position of the second lever 28 on the pivot 30. In other words, since the rotational position of the lever 28 is dependent on a balance of the forces exerted by the fluid on the diaphragm 49 and the coaxial spring 34, any change in the position of the end of the second rod 38 bearing on the second diaphragm 49 produced by a rotation of the rod 38 would produce a translational movement of the rod 38 as a new force balance is achieved. This translational motion is effective to produce a corresponding movement of the lever 28 on the pivot 30 either to allow an expansion of the spring 34 or a compression of the spring 34 whereby to move the lever 28 toward the switch 22 or away from the switch 22, respectively. This movement of the second lever 28 rotates the lever 28 on the pivot 30 and changes the spacing of the switch operating end 27 of the lever 28 from the switch actuator pin 26, e.g., an increase in the separation between the lever end 27 and the pin 26. A change in the spacing between the lever end 27 and the pin 26 is effective to alter the differential temperature needed to produce a switch actuation, e.g., an increase in the spacing requires an increase in the temperature sensed by the second bulb 44 to produce a restoration of the switch actuation, i.e., to produce a greater "chase" of the switch actuating end 27 of the lever 28 toward the actuating pin 26, and vice versa. Thus, the indication of the dial 39 can be calibrated to show the differential temperature of the illustrated control.

One application for the invention disclosed herein would be as a control for a fan motor on a forced air furnace. The differential temperature sensed by the control would be between the return air and the warm air supply. Thus, the first bulb 2 would be located in the warm air plenum and the second bulb 44 in the return air duct. This arrangement would allow an extraction of the maximum heat from the furnace regardless of the return air temperature. For example, if the enclosure supplied by the furnace is to be maintained at 80° F., the fan could be set to run at an 85° F. warm air temperature, i.e., a 5° F. differential. With a night setback at 60° F., the fan would run down to a 65° F. temperature of the warm air supply.

Accordingly, it may be seen that there has been provided, in accordance with the present invention, an improved differential temperature control.

The embodiments of the invention in which an exclusive property of privilege is claimed are defined as follows:

1. A differential temperature control comprising:

a first lever means including a first pivoted lever, a selectively actuable switch means having a switch actuator and being mounted on a free end of said lever, a first temperature responsive means for rotating said lever on its pivot, a second lever means including a second pivoted lever having a switch actuating free end facing said switch actuator and a second temperature responsive means for rotating said second lever on its pivot to selectively position said free end of said second pivoted lever, said first lever means including a first spring means arranged to maintain a contact between said first lever means and said first temperature responsive means, said spring means including a length expandable means arranged to selectively vary the rotational position of said first lever means on its pivot independently of said first temperature responsive means.

2. A differential temperature control as set forth in claim 1 wherein said first and second temperature responsive means each include a bulb, a fluid pipe, a fluid chamber covered by a flexible diaphragm in contact with a corresponding one of said first and second lever means and a temperature sensitive fluid filling said bulb, said pipe and said chamber.

3. A differential temperature control as set forth in claim 1 and further including a support means, a first pivot means attached to said support means for providing a pivot for said first lever and a second pivot means attached to said support means for providing a pivot for said second lever.

4. A differential temperature control as set forth in claim 1 wherein said second lever means includes a second spring means arranged to maintain a contact between said second lever and said second temperature responsive means.

5. A differential temperature control as set forth in claim 4 wherein said second spring means includes a second length expandible means arranged to selectively vary the rotational position of said second lever on its pivot independently of said second temperature responsive means.

6. A differential temperature control as set forth in claim 5 wherein said second expandible means includes an indicating means for providing a representation of a variation in the length of said second expandible means.

7. A differential temperature control as set forth in claim 6 wherein said first and second temperature responsive means each include a bulb, a fluid pipe, a fluid chamber covered by a flexible diaphragm in contact with a corresponding one of said first and second lever means and a temperature sensitive fluid filling said bulb, said pipe and said chamber.

8. A differential temperature control as set forth in claim 6 and further including a support means, a first pivot means attached to said support means for providing a pivot for said first lever and a second pivot means attached to said support means for providing a pivot for said second lever.

* * * * *